United States Patent [19]

Campbell

[11] 4,277,932

[45] Jul. 14, 1981

[54] CASE PACKING MACHINE

[75] Inventor: Barry Campbell, Spokane, Wash.

[73] Assignee: R. A. Pearson Company, Spokane, Wash.

[21] Appl. No.: 84,790

[22] Filed: Oct. 15, 1979

[51] Int. Cl.[3] ..... B65B 5/08; B65B 39/02

[52] U.S. Cl. ..... 53/497; 53/247; 53/248; 53/543

[58] Field of Search ..... 53/48, 496, 497, 539, 53/543, 242, 243, 247, 248, 252, 258

[56] References Cited

U.S. PATENT DOCUMENTS

| | | | |
|---|---|---|---|
| 2,834,167 | 5/1958 | Loveridge | 53/496 |
| 3,406,493 | 10/1968 | Katogir | 53/48 X |
| 3,443,355 | 5/1969 | Birrell | 53/544 X |
| 3,452,508 | 7/1969 | Dzenis | 53/48 |
| 3,546,837 | 12/1970 | Shuttleworth | 53/497 |
| 3,672,117 | 6/1972 | Shuttleworth et al. | 53/248 X |
| 3,778,965 | 12/1973 | O'Lenick et al. | 53/248 |
| 3,788,034 | 1/1974 | Hartness et al. | 53/248 |
| 3,826,382 | 7/1974 | Zappia | 53/247 |
| 3,864,890 | 2/1975 | Ullman | 53/248 X |
| 3,869,843 | 3/1975 | Darrah et al. | 53/247 X |
| 3,908,812 | 9/1975 | Graff | 53/247 X |
| 3,926,336 | 12/1975 | Graham et al. | 53/248 X |
| 3,965,650 | 6/1976 | Nussbaum | 53/248 X |
| 3,991,539 | 11/1976 | Luca | 53/248 X |
| 4,175,364 | 11/1979 | Becker et al. | 53/248 X |
| 4,215,521 | 8/1980 | Hartness | 53/248 |

*Primary Examiner*—Horace M. Culver

*Attorney, Agent, or Firm*—Wells, St. John & Roberts

[57] ABSTRACT

A case packing machine is described for bottles having enlarged neck flanges. The machine first arranges bottles received from a conveyor into a group on an escapement mechanism. The grouped bottles are suspended from their enlarged neck flanges by an escapement mechanism at a first station. The group is released as a ram engages the bottle finishes and shifts them downwardly to a second station. An actuator on the ram functions to operate the escapement mechanism and a bottle stop mechanism is also operated directly from the ram to halt further progress of bottles toward the escapement mechanism during release and movement of the previous group of bottles to the second station. Bottles may be received by an invertible holder at the second station. The holder forms the bottles into a prescribed rectangular array and supports the bottles until a subsequent group is received. The subsequent received group engages and moves the first group downwardly into a case waiting at a packing station below.

14 Claims, 8 Drawing Figures

FIG 6
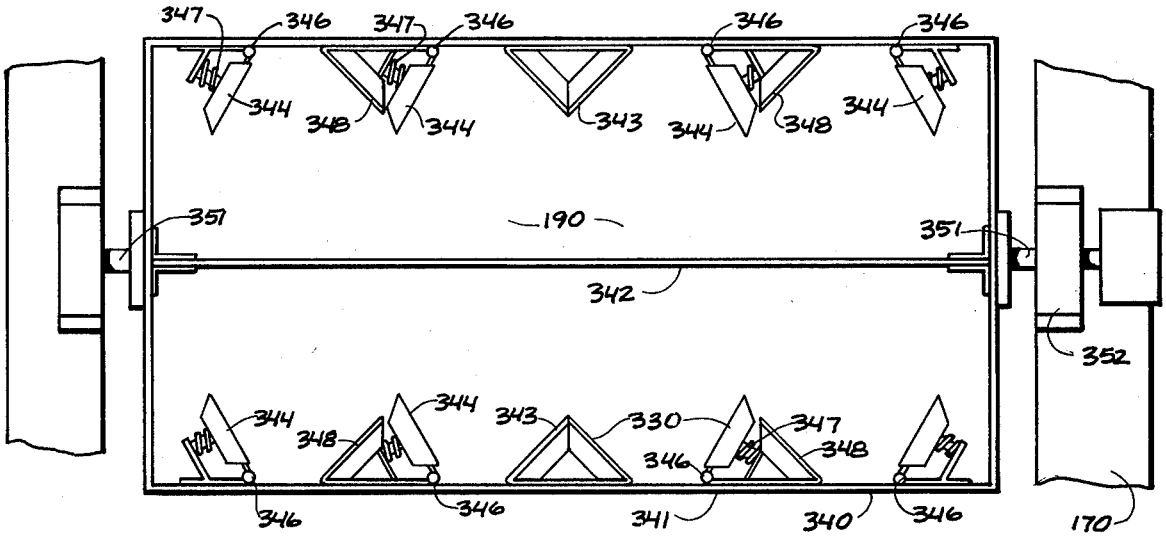
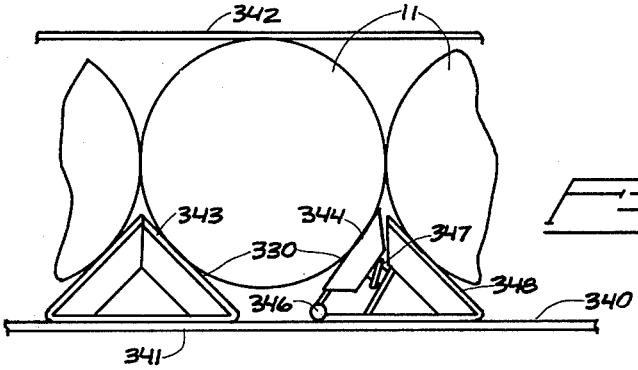
FIG 7
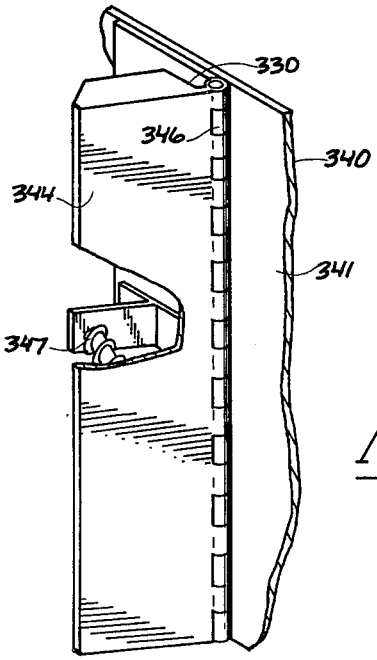
FIG 8

CASE PACKING MACHINE

BACKGROUND OF THE INVENTION

The present invention is concerned with a machine for packing groups of bottles into open cases. It is designed to place a selected group of bottles within a shipping case or container for packing and shipping purposes.

Lightweight plastic disposable bottles for beverages or other fluids are currently becoming popular in the bottling industry. Such bottles are easily damaged in handling. The bottles are not easily packed horizontally into cases. It is more desirable to move the bottles vertically. Controlling movement of the bottles is difficult because of their lightweight nature. The bottles do not fall freely and predictably. It is therefore necessary to provide a case packing machine that will automatically load groups of such bottles vertically into cases while maintaining full control over bottle movement. Additionally, it is desirable to have the capability to pack cases with bottles in inverted positions to maintain the uncovered empty bottles in a clean condition.

A case packing machine that packs such bottles vertically into cases has been developed and produced by the applicant. It is described in pending U.S. Pat. application Ser. No. 955,350, filed Oct. 27, 1978 and titled "Case Packing Machine".

In the prior case packing machine, successive groups of bottles are delivered to an escapement mechanism at a first elevational station. Separate pneumatically actuated ram and escapement release mechanisms are sequenced to release and force the grouped bottles downwardly to a second station. Bottles are received at the second station within one of two laterally slidable and rotatable chutes. The chutes are mounted to a carriage that is powered to shift laterally after receiving a charge of bottles, moving the bottles in one chute to positions directly below a discharge ram mechanism. This movement also brings a second chute into alignment below the escapement and ram mechanisms for the purpose of receiving a second set of bottles. While this second set of bottles is being received, the discharge ram is lowered, pushing a group of bottles into a case below. The shuttle carriage is then shifted back, moving a second group of bottles to a second laterally spaced position and returning the first carriage into alignment below the escapement and bottle ram. A second discharge ram assembly is provided adjacent this position to lower and push the bottles from the second carriage downwardly into a case.

It is an object of the present improvement to provide a bottle packing machine of simplified construction and operation that will operate at an equal or greater rate of speed than known prior bottle packing machines of the same nature.

This is done by a machine with a single bottle holder below the escapement mechanism that will receive successive groups of bottles, hold them in a defined cluster, and discharge the bottles in response to downward forces exerted by a subsequent group of bottles released from the escapement above. Simplicity is achieved by operating the escapement means directly in response to operation of the bottle ram mechanism. Loading of bottles onto the escapement mechanism is also accomplished in response to motion of the ram mechanism.

BRIEF DESCRIPTION OF THE DRAWINGS

FIG. 6 is a fragmentary plan view of a holder;

FIG. 7 is an enlarged fragmentary view of a portion of the holder shown in FIG. 6 showing placement of bottles therein; and FIG. 8 is a pictorial detail of a portion of the holder.

DETAILED DESCRIPTION OF A PREFERRED EMBODIMENT

Figure 1:
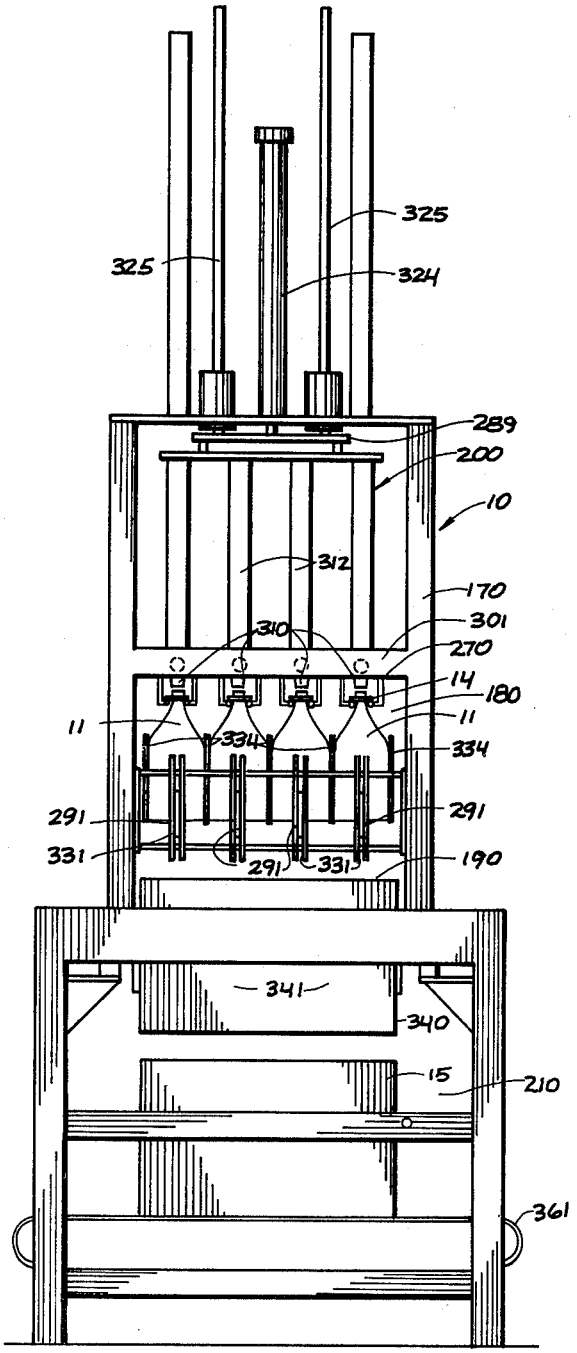
FIG. 1 is a front elevational view of the present case packing machine.

A case packer embodying a preferred form of the present invention is generally designated by the reference character 10. The present case packer 10 is designed for use in handling empty or filled containers, especially bottles such as those diagrammatically illustrated at 11. Each bottle includes a reduced neck 12 leading to a "finish" 13, that includes an enlarged neck flange 14. The bottles 11 are automatically collected by the machine and placed into upwardly open cases 15 (FIG. 1).

The case packer 10 is supported by a general framework 170 along which are defined several work stations. A different step in the process of loading the bottles into the cases is performed at each station. The several stations are separated elevationally. A first station 180 is where bottles initially enter the machine. A second station 190 is situated elevationally below station 180. Preferably, the second station 190 is vertically aligned with the first station 180.

Bottles are shifted from the first station 180 vertically to the second station 190. This is accomplished by a bottle ram means 200 which moves vertically, engaging bottles at the first station, and forcing them downward to the second station.

The second station 190 as illustrated is an intermediate station where bottles are received, gathered into defined rectangular clusters, and elevationally discharged. Preferably, the defined clusters of bottles at the second station are guided downwardly to a case packing station 210 below. Alternatively, however, waiting cases could be filled directly at the second station 190. In this instance the ram means 200 would push bottles from the first station downwardly to be guided in a defined cluster directly into a waiting case at the second station.

The following, more detailed description of the invention is given below in the arrangement of the successive stations.

THE FIRST STATION

Figure 2:
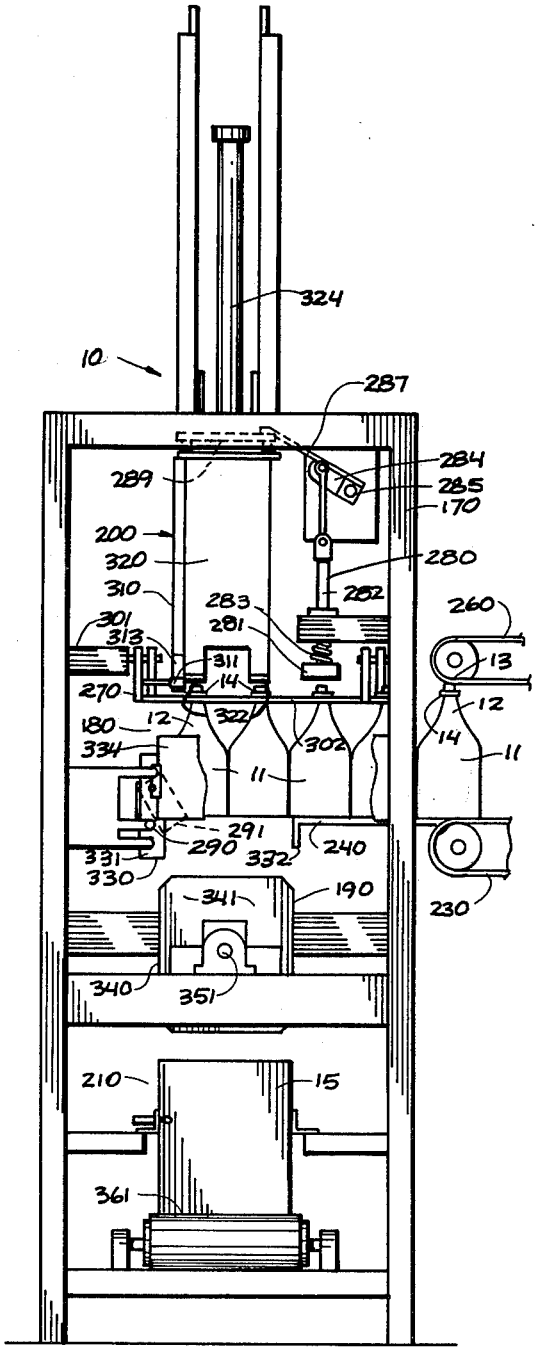
FIG. 2 is a side elevational view of the machine.

Individual bottles are fed horizontally to the case packer 10 at the level of the first station 180. FIG. 2 illustrates a fragment of a horizontal infeed conveyor 230 that is utilized to move the bottles horizontally toward station 180. The conveyor 230 may be an appropriate form of pallet type conveyor commonly utilized for moving bottles horizontally. Conveyor 230 leads horizontally to a stationary plate 240. The plate 240 is co-extensive of the working flight for conveyor 230 and includes a smooth upper surface for slidably receiving and supporting the bottles.

The working flight of the pallet conveyor 230 includes a smooth surface that will slide beneath the bottles if they meet resistance to further motion. A hold-down conveyor 260 is provided to assure fast forward motion of bottles along the conveyor 230. Conveyor 260 is mounted above the working flight of conveyor 230 to engage the bottle finishes 13.

Conveyor 260 is made up of a series of belts oriented parallel to the flights of conveyor 230. The speed of the belts is identical to that of conveyor 230. They are driven directly by conveyor 230. They function to hold the bottles upright and to prevent sliding of the bottles over the working surface of the pallet conveyor 230.

The hold-down conveyor is spaced above the working flight of the infeed conveyor 230 so its working flights slidably engage the bottle finishes, and like the surface of conveyor 230, will slide over the engaged bottles as forward progress of the bottles is stopped on the conveyor. Both conveyors produce a continuous forward thrust against the bottles, urging them toward the first station 180.

The bottles will slide across the plate 240 and into engagement with an escapement means 270 (described below). As the escapement means 270 becomes full, further progress of the bottles on the conveyor and plate is halted. Both conveyors 230 and 260 then slide over the bottle surfaces while urging them toward the first station 180.

The bottle ram means 200 is operated to move the bottles from the escapement mechanism to the second station. During this time a stop means 280 operates to halt forward progress of the bottles across the plate 240. This frees the grouped bottles for vertical movement in response to actuation of the ram means between the first and second station and allows subsequent filling of the escapement means 270 as the stop means releases the bottles.

Figure 4:
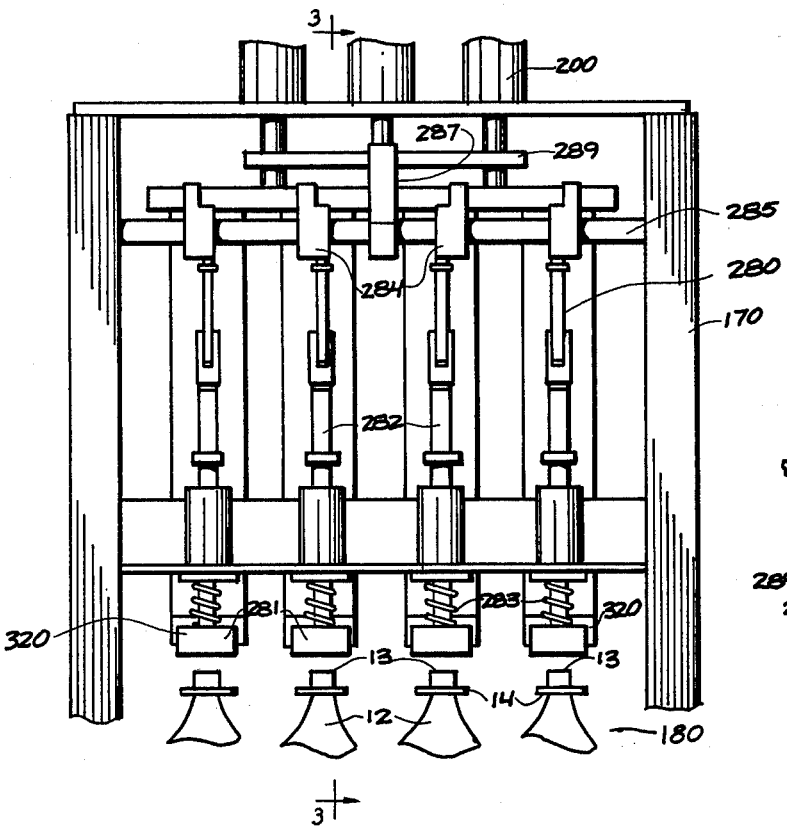
FIG. 4 is a fragmentary rear view of the bottle stop mechanism shown in FIG. 3.
Figure 3:
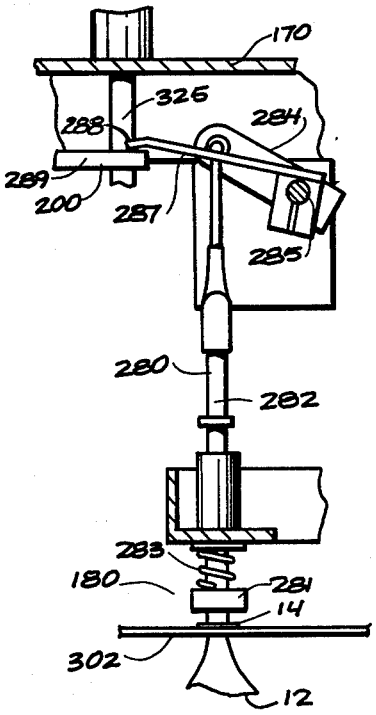
FIG. 3 is a fragmentary detailed view illustrating a bottle stop mechanism taken along line 3—3 in FIG. 4.

The stop means 280 is operational in response to operation of the bottle ram means 200. The bottle stop means is shown in substantial detail by FIGS. 3 and 4. Bottle stop means 280 includes a plunger pad 281 for each bottle in a transverse row on plate 240 directly adjacent the escapement means 270. The pads 281 are mounted at bottom ends of upright, vertically movable connecting rods 282. The pads are urged toward a downward, finish engaging position (FIG. 3) by compression springs 283.

Upper ends of the connecting rods 282 are pivotably mounted to crank arms 284. The arms 284 extend from ends mounting the connecting rods 282 to inward ends fixed to a pivotable rocker shaft 285. Pivotal movement of the rocker shaft 285 will therefore cause corresponding vertical movement of the connecting rods and plunger pads.

The stop means 280 is operated by a feeler 287 that is mounted rigidly to the rocker shaft 285 and extends outwardly to engage ram means 200. The feeler 287 extends to a free end 288 that pivots on the axis of rocker shaft 285 in response to engagement with a movable plate 289 of the bottle ram means 200. The feeler will pivot downwardly when the ram means descends. The compression springs urge the plunger pads 281 downwardly against the finishes of the bottles below, clamping them against the plate 240. The bottles thus clamped will act as abutments for the following bottles on plate 240, causing them to stop and back up the incoming bottles along the conveyors 230 and 260.

Subsequently, as the ram means is moved upwardly, the plate 289 contacts the feeler 287 and lifts it upwardly. This forces corresponding pivotal movement of the rocker shaft 287 and lifts the crank arms 284. The crank arms 284 lift the connecting rods 282 and plunger pads 281 against resistance of the springs 283. The disengaged bottles are then free to slide from plate 240 and onto the escapement means 270.

Bottles being loaded onto the escapement means 270 are detected by a sensing mechanism, such as a photocell arrangement 290 (FIG. 2) mounted on the general framework 170. A series of apertured flags 291 are freely pivoted on the framework 170. Each flag is positioned to be engaged by a bottle as the escapement mechanism is being filled. The flag will pivot, in response to a forwardly moving bottle, to move its open aperture into alignment with a light beam produced at one side of the escapement mechanism. When each flag has been thus pivoted, the light beam will shine through the aligned apertures and be reflected, producing a signal through actuation of an appropriate photocell. Such signal indicates that the escapement mechanism has received a sufficient number of bottles to continue operation. The signal can also serve to initiate operation of the ram means. if an insufficient number of bottles are received, no signal will be produced and the ram means will not operate.

The conveyor 230 feeds the escapement means 270 which is situated at the first station 180 to alternately receive, suspend, and release successive groups of bottles. The escapement mechanism 270 is mounted along an escapement framework 301 that is an integral part of the framework 170. The escapement means 270 includes at least one pair of elongated parallel escapement bars 302.

Preferably, there is one pair of bars for each row of bottles received from the infeed conveyor 230. Thus, as shown in FIG. 1, there are four pairs of bars for four rows of bottles. The bars 302 extend horizontally from and parallel to the infeed conveyor 230.

Figure 5:
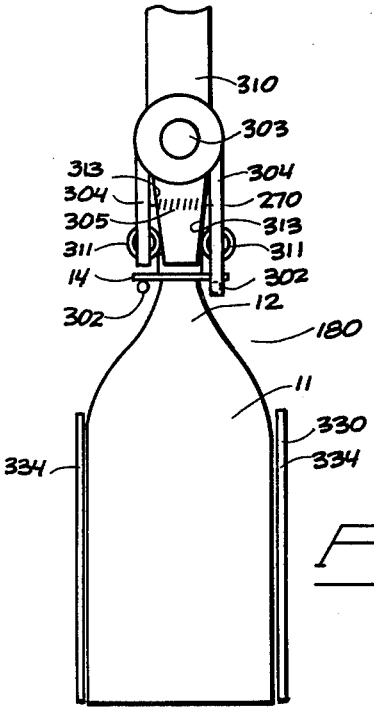
FIG. 5 is a fragmentary elevational view of an escapement mechanism.

The bottles are engaged and suspended from their neck flanges 14. Bottles slide between the escapement bars 302 by continuous pressure from the bottles on conveyors 230 and 260. FIG. 5 indicates the point of engagement between a bar 302 and a bottle neck flange 14 engaged thereby.

A pivot 303 mounts each pair of the elongated escapement bars 302. The bars 302 are mounted on the pivots for movement between closed positions for receiving and suspending successive groups of bottles, and open positions for releasing the successive groups.

Connecting members 304 extend between the pivots 303 and escapement bars 302. The connecting members 304 permit pivotal movement of the bars 302 about the horizontal axis of the pivots 303. A tension spring 305 is provided for each pair of connecting members 304. The springs 305 interconnect the adjacent cnnecting members 304 and urge the associated escapement bars 302 toward their normal closed bottle engaging positions.

An escapement actuator means is generally designated by the numeral 310. Its functions to selectively move the escapement bars 302 about the pivot axes of pivots 303 between the two positions. This is done directly in response to movement of the bottle ram means 200.

The escapement actuator means 310 may include cam followers 311 mounted at outward ends of the escapement bars 302. The cam followers 311 are shown as rollers freely rotatable about axes parallel to the escapement bar pivot axes. Cam 312 are mounted to the bottle ram means for vertical movement therewith. The cams 312 include inclined cam surfaces 313 for engaging and operating against the cam followers 311. The cam surfaces 313 are formed in wedge configurations and move vertically between each follower of a pair of escapement bars 302. The surfaces 313 will urge the followers apart upon downward movement of the cams, and will allow the followers to move toward one another due to tension of the springs 305 as the cams are elevated with the bottle ram means 200.

Timing of bottle release from the escapement means 270 is determined by the vertical positioning of the cams on the bottle ram means. It is preferred that the cams operate to separate the escapement bars momentarily before the bottle finishes are engaged by the ram means. Such timing will assure contact and controlled descent of the grouped bottles from the first to the second position. The cams 312 are movably mounted to the bottle ram means 200 to enable selective timing of the bottle escapement release and engagement of the bottles by the ram means.

The bottle ram means 200 includes a plurality of vertically oriented plungers 320. A single plunger is supplied for each line of bottles on the escapement means 270. Each plunger further includes a distended lower end having pads 322 mounted thereon. The pads 322 are preferably formed of a resilient material so as not to damage the bottles finishes. Bottom surfaces of the pads 322 engage the bottle finishes and move downwardly with the remainder of the ram means to urge the bottles from the first to the second station.

Movement of the ram means 200 is accomplished by an upright cylinder 324 mounted to the general framework 170. The cylinder 324 is connected directly to the interconnected upper ends of plungers 320 by plate 289. Extension of the cylinder vertically will cause corresponding downward movement of plungers 320. This downward movement is guided by rods 325 by opposite sides of cylinder 324. Appropriate switches and control mechanisms (not shown) may be provided along the path of the cylinder piston or along the guide rods 325 in order to effectively control sequential operation of the present packer.

A substantial advantage is gained through the direct mechanical interconnection of the stop means 280 and escapement actuator means 310 with the bottle ram means 200. First, operation of both the stop means and the actuator means can be precisely timed in relation with the ram means. Furthermore, the drive mechanisms operating the ram means (cylinder 324) is also utilized to operate the stop means and escapement actuator. Therefore, separate drive and control mechanisms for these elements are eliminated, along with the resulting complexity of construction, operation and maintenance.

THE SECOND STATION

As discussed above, the second station 190 is situated directly below the first station 180. Here, bottles are received in successive groups and guided into defined clusters (preferably rectangular) by a guide means 330. The guide means 330 broadly includes several elements that are utilized to receive and direct movement of the bottles from the first to the second station.

The first guiding elements are upright guide members 331 adjacent the forward side of the first station. Also, at the first station is a lip 332 (FIG. 2) on plate 240 at the back side of the first station to prevent backward movement of the bottles and to guide them vertically downwardly. Lateral movement of the bottles is prevented at the first station by partitions 334. Partitions 334 extend parallel to the paths of the bottles on the conveyor 230. The partitions are shown particularly in FIGS. 1 and 2.

The guide means 330 also broadly includes a holder 340 that is situated at the second station for receiving the groups of bottles from the above guides and for collecting the groups into defined rectangular clusters. The holder 340 is preferably mounted for pivotal movement about a horizontal axis so that successive clusters of bottles may be inverted prior to being discharged into a case waiting below.

The holder 340 is shown in substantial detail by FIGS. 6 through 8. It basically includes a box frame 341 having opposed horizontal open ends. The frame 341 is shown in plan view in FIG. 6 with a central vertical partition 342 evenly dividing the the interior. Triangular upright center guides 343 are fixed to opposite sides of the box frame and face inwardly toward the center dividing wall 342. The guides 343 are centered on the long sides of the rectangular box frame. Their outwardly facing stationary sides serve to engage and guide bottles downwardly in addition to assisting with the forming of groups of bottles into rectangular clusters.

Bottle engaging plates 344 are spaced along the walls of the box frame 341 to opposite sides of the center guides 343. Bottle engaging plates 344 are flared at opposed ends to receive and guide individual bottles toward the vertical surfaces of the plates. The bottle engaging plates 344 are pivoted about vertical axes by hinges 346. These hinges are preferably "piano" hinges with a base of each fixed directly to the box frame 341. Springs 347 are situated between the hinge base plates and the pivotable bottle engaging plates 344. The springs 347 yieldably urge the plates 344 and the bottles engaged thereby toward the central wall 342 and toward engagement with the remaining bottles of the cluster. The spring tension can be adjusted to accomodate different sizes of bottles.

The bottle engaging plates 344 that are situated along the box frame sides directly adjacent to the triangular upright center guides 343 include stationary back guide surfaces 348. The back guide surfaces 348 are vertical. They function, as shown in FIG. 7, to direct bottles inwardly toward adjacent bottles held against the center guides 343 and inwardly toward the central wall 342. The desired rectangular cluster of bottles is thereby formed as the bottles are moved downwardly from the first station.

The central wall 342, plates 344 and back guide surfaces cooperate to hold a received group of bottles in a defined cluster, suspending them above the case packing station. Frictional engagement is such that the bottles can be forced downwardly through the lower open end of the box to the case packing station below. A subsequently received group of bottles can therefore be used to push the first set downwardly to the case packing station.

The box frame 341 is mounted by pivot shafts 351 to the general framework 170. A rotator means 352 is provided to rotate the box about the horizontal axis of pivot shaft 351 through an arc of 180°. The means 352 may be comprised of a conventional double acting rotary actuator, connected directly between the frame and the pivot shafts 351. Bottles held upright by the box can therefore be inverted prior to being discharged into a case below. The next group of bottles entering the box pushes the inverted bottles into the waiting case. The bottles located within the box can then be rotated through the 180° arc as the holder 340 is pivoted back to its original position. This oscillating motion may continue so long as it is desired to fill cases with inverted bottles. Of course, if it is desired to pack bottles upright into cases, it is not necessary to rotate the holder.

It is conceivable that there be no need for bottles to be inverted by a holder mechanism 340. In such instances, the holder 340 may be eliminated and the guide means 330 can be mounted directly to the general framework. The case packing station could then be situated at the second station. There, the successive cases would receive clusters of bottles directly from the escapement mechanism as they are lowered by the ram means 200.

THE CASE PACKING STATION

There is a single case packing station space directly below the first station 180 where successive groups of bottles are moved from the holder 340 and deposited into a case 15. Means is provided in the form of a common horizontal conveyor 361 for positioning successive cases 15 at the case packing station. The conveyor 361 can be timed by conventional controls (not shown) to stop successive cases at the loading station in coordination with operation of the remainder of the case packer. Each case on the conveyor will thus receive a cluster of bottles from the holder.

OPERATION

A group of bottles is fed horizontally to the first station 180 by the horizontal infeed conveyor 230. The hold-down conveyor 260 will engage the bottle finishes to hold the bottles upright as they move quickly onto the escapement mechanism of the first station 180. The sensing mechanism is utilized to determine that a specific number of bottles have been received by the escapement means 270. An operational cycle of the ram means 200 is then initiated. The descending ram means also causes corresponding operation of the escapement actuator means 310 and the stop means 280.

The downwardly moving ram allows the feeler 287 to pivot downwardly. The compressed springs 283 of the stop means 280 are then free to urge the plunger pads 281 down against the finishes of bottles resting on the plate 240. The clamped bottles will thus block further forward movement of bottles on the infeed conveyor 230. These bottles will remain stationary with the working surfaces of conveyor 230 and hold-down conveyor 260 simply sliding over the engaged bottle surfaces. The conveyors therefore continuously urge the bottles toward the first station and, when the stop means is later released, will quickly move the bottles forwardly to again fill the escapement mechanism.

The escapement mechanism 270 also functions in response to movement of the ram means either simultaneously with or slightly delayed from operation of the bottles stop mechanism. The downwardly moving actuator means 310 operates as the cams 312 move downwardly with the ram means 200 into contact with the cam followers 311 on escapement bars 302. The cams force the bars 302 apart until they release the enlarged neck flanges 14 of the bottle group.

The ram plungers contact the bottle finishes at the instant the bottles are released from the bars 302. The plungers force the bottles downwardly along the guide means 330 to the second station 190. Movement of the plungers is preferably greater than the rate at which the bottles could free fall upon being released from the escapement bars. This assures positive bottle control by the ram means from the first to the second station.

The bottles being moved downwardly are guided from the first station by the upright guides 331, the lip 332 of plate 240, and the spaced partitions 334. The substantially rectangular pattern of the group is thereby maintained as the plungers move the bottles downwardly.

The guide means 330 further functions to receive and urge the bottles into a defined, rectangular pattern as they are received at the second station. This is preferably done within the holder 340. The group of bottles is moved through the upwardly open box frame end and into engagement with the triangular upright center guides 343 and the bottle engaging plates 344. The bottles are held in the defined cluster within the box frame 341 as the ram means 200 is retracted upwardly.

Upward movement of the ram brings the cams 312 out of engagement with the cam followers 311. This allows the springs 305 to return the escapement bars 302 to their normal closed condition. The upwardly moving ram means brings the plate 289 into engagement with the feeler 287. The upwardly pivoting feeler pivots the rocker shaft 285 and lifts the bellcrank arms 286. The arms 286, in turn, lift the plunger pads 281 from engagement with the bottles below. The released bottles are then free to slide over the plate 240 and onto the escapement bars 302, filling the escapement means 270.

Subsequent reactuation of the ram means 200 begins a repeat of the operation as described above for the first group of bottles (which are now presently waiting within the holder 340). The subsequent group of bottles is moved downwardly by the bottle ram means 200 to engage the cluster of bottles within the holder, pushing them downwardly from the holder and into a case waiting below on the conveyor 361. This completes a full cycle in the operation in which a group of bottles is moved from the infeed conveyor, through the case packing machine, and into a case.

The above operation may be somewhat altered by the rotational capability of the holder 340. For example, the holder may receive a group of bottles from the ram means, and as the ram means is retracting upwardly, the rotator means 352 may be actuated to cause a 180° movement of the holder 340. The first cluster of bottles is thus held inverted by the box frame. A subsequent group of bottles moved downwardly by the ram means will thus engage the bottoms of the inverted bottles, pushing them in the inverted positions downwardly into a case. The bottles received by the holder are upright. Pivotal movement of the holder back to its original angular position will thus cause inversion of the subsequently received cluster of bottles.

It should be noted that the above description and attached drawings are given merely as examples to set forth a preferred form of the present invention. The following claims are to be taken as limitations upon the scope of the invention.

What is claimed is:

1. In a case packer for automatically packing bottles into cases, each bottle having an enlarged neck flange adjacent the bottle finish;

a framework;

a first station on the framework;

a second station on the framework below the first station;

conveyor means adjacent the first station for delivering groups of bottles to the first station;

bottle escapement means at the first station for receiving successive groups of bottles from the conveyor means, suspending the bottles by individual engagement of downwardly facing surfaces of the neck flange thereof and for selectively releasing the bottles as a group by disengaging the neck flanges;

bottle ram means adjacent the first station for engaging and moving successive groups of bottles from the first station to the second station;

escapement actuator means fixed on the bottle ram means for operating the escapement means to release a group of bottles in response to movement of the bottle ram means toward the second station;

an open ended holder on the framework at the second station for receiving, slidably supporting, and discharging successive groups of bottles delivered to the holder from the ram means and bottle escapement means; and guide plates within the holder for urging each successive group of bottles to a defined cluster, for holding the bottles within the cluster, and for guiding the defined cluster of bottles downwardly in response to reception of a subsequent group of bottles from the ram means and bottle escapement means.

2. The apparatus as defined by claim 1 further comprising stop means adjacent the conveyor means operative in response to movement of the ram means toward the second station for halting progress of bottles on the conveyor means toward the first station while the ram means operates to move a group of bottles from the first station to the second station and for subsequently releasing the bottles to be fed into the escapement means.

3. The case packer as defined by claim 1 wherein the ram means includes a plunger assembly on the framework, vertically movable between a raised position above the first station and escapement means, and a lowered position adjacent the second station.

4. The case packer as defined by claim 3 further comprising stop means on the framework connected to the plunger assembly for operation in response to movement thereof to (1) halt progress of bottles on the conveyor means toward the first station as the plunger assembly is moved toward the lowered position, and (2) release the bottles for movement toward the first station as the plunger assembly is raised past the escapement means to the raised position.

5. The apparatus as defined by claim 1 wherein the first and second stations are in vertical alignment, with the first station above the second station and further comprising:

means for rotating the holder on the framework about a fixed, horizontal axis.

6. The apparatus as defined by claim 5 wherein the holder is oscillated through an angle of 180° about the fixed horizontal axis.

7. The apparatus as defined by claim 5 wherein the ram means, escapement means and holder are in vertical alignment, and wherein the conveyor means feeds bottles horizontally to the escapement means.

8. The apparatus as defined by claim 7 wherein the holder is positioned directly below the first station so bottles released by the escapement means will be received and supported by the holder at the second station and so the bottles held by the holder will be displaced downwardly by the next successive group of bottles received from the first station by operation of the ram means and the escapement means.

9. A case packer for automatically packing bottles into cases, each bottle having an enlarged neck flange adjacent the bottle finish, comprising:

a framework;

a first station on the framework;

a second station vertically below the first station;

horizontal conveyor means leading to the first station for delivering groups of bottles to the first station;

escapement means at the first station for receiving successive groups of bottles from the conveyor means, suspending the bottles by individual engagement of the neck flanges thereof at the first station, and for selectively releasing the bottles as a group by disengaging the neck flanges;

bottle ram means above the first station for successively moving downwardly to engage groups of bottles on the escapement means at the finishes thereof and to forcibly move the engaged group of bottles downwardly to the second station;

escapement actuator means on the bottle ram means for operating the escapement means to release the bottles as a group in response to downward movement of the ram means toward the second station;

means for vertically guiding the groups of bottles downwardly after release by the escapement means and for forming the successive groups into defined clusters; and means for positioning a case below the escapement means to receive successive clusters of bottles;

wherein said means for vertically guiding the groups of bottles comprises:

an open ended holder on the framework at the second station for receiving, slidably supporting, and discharging successive groups of bottles from the ram means and escapement means; and wherein the guide means includes spring guide blades within the holder for urging each successive group of bottles to a defined cluster, for holding the bottles within the cluster, and for guiding the defined cluster of bottles downwardly in response to reception of a subsequent group of bottles from the ram and escapement means.

10. The apparatus as defined by claim 9 further comprising stop means adjacent the conveyor means operative in response to movement of the ram means toward the second station for halting progress of bottles on the conveyor means toward the first station while the ram means operates to move a group of bottles from the first station to the second station and for subsequently releasing the bottles to be fed into the escapement means.

11. The apparatus as defined by claim 9 wherein the ram means, escapement means and holder are in vertical alignment, and wherein the conveyor means feeds bottles horizontally to the escapement means.

12. The apparatus as defined by claim 11 wherein the holder is positioned directly below the first station so bottles released by the escapement means will be received and supported by the holder at the second station and so the bottles held by the holder will be displaced downwardly by the next successive group of bottles received from the first station by operation of the ram means and the escapement means.

13. A case packer for automatically packing bottles into cases, each bottle having an enlarged neck flange adjacent the bottle finish, comprising:

a framework;

a first station on the framework;

a second station vertically below the first station;

horizontal conveyor means leading to the first station for delivering groups of bottles to the first station;

escapement means at the first station for receiving successive groups of bottles from the conveyor means, suspending the bottles by individual engagement of the neck flanges thereof at the first station, and for selectively releasing the bottles as a group by disengaging the neck flanges;

bottle ram means above the first station for successively moving downwardly to engage groups of bottles on the escapement means at the finishes thereof and to forcibly move the engaged group of bottles downwardly to the second station;

escapement actuator means on the bottle ram means for operating the escapement means to release the bottles as a group in response to downward movement of the ram means toward the second station;

means for vertically guiding the groups of bottles downwardly after release by the escapement means and for forming the successive groups into defined clusters; and means for positioning a case below the escapement means to receive successive clusters of bottles;

wherein said means for vertically guiding the groups of bottles comprises:

an open ended holder on the framework at the second station for receiving, slidably supporting, and discharging successive groups of bottles from the ram means and escapement means; and wherein the guide means includes spring guide blades within the holder for urging each successive group of bottles to a defined cluster, for holding the bottles within the cluster, and for guiding the defined cluster of bottles downwardly in response to reception of a subsequent group of bottles from the ram and escapement means;

said escapement means comprising:

a plurality of pairs of parallel horizontal escapement rods, each pair being pivoted on the framework about an axis parallel to the rod lengths and oriented longitudinally with respect to the direction of incoming bottles;

cam followers on the escapement rods;

cams on the bottle ram means above and between the cam followers for engaging and forcing the cam followers and escapement rods apart in response to downward movement of the bottle ram means; and spring means for normally urging the escapement rods of each pair toward each other.

14. The case packer as defined by claim 13 wherein the conveyor means is comprised of a horizontal endless pallet conveyor powered to continuously urge bottles resting on a working flight thereof toward the first station, and a hold-down conveyor spaced above the pallet conveyor for engaging the bottle finishes and for urging the bottles downwardly onto the pallet conveyor as they are moved toward the first station.

* * * * *